United States Patent [19]

Rubin

[11] 4,141,163

[45] Feb. 27, 1979

[54] SIGHTING DEVICE FOR FIREARMS

[76] Inventor: Harry R. Rubin, 80 York Ter., Brookline, Mass. 02146

[21] Appl. No.: 820,201

[22] Filed: Jul. 29, 1977

[51] Int. Cl.[2] ..... F41G 1/04; F41G 1/42

[52] U.S. Cl. ..... 42/1 S; 33/244

[58] Field of Search ..... 42/1 S, 1 ST; 33/233, 33/244, 245, 261; D22/8; D16/11

[56] References Cited

U.S. PATENT DOCUMENTS

| | | | |
|---|---|---|---|
| 1,380,150 | 5/1921 | Keeran | 33/261 |
| 1,653,924 | 12/1927 | Parker | 33/233 |
| 2,030,312 | 2/1936 | Mossberg | 42/1 S |
| 2,932,896 | 4/1960 | Hicinbothem | 33/244 |
| 3,499,224 | 3/1970 | Squier et al. | 42/1 S |

FOREIGN PATENT DOCUMENTS

| | | | |
|---|---|---|---|
| 190752 | 7/1937 | Switzerland | 42/1 S |

*Primary Examiner*—Charles T. Jordan

*Attorney, Agent, or Firm*—Scott R. Foster

[57] ABSTRACT

A sighting device for disposition proximate a muzzle end of a firearm, the device comprising a first elongated planar member and a second elongated planar member disposed in a plane different from the plane of the first member, each planar member intersecting the plane of the other member at the center of the other member.

5 Claims, 4 Drawing Figures

SIGHTING DEVICE FOR FIREARMS

BACKGROUND OF THE INVENTION

1. Field of the Invention

This invention relates to sighting devices and is directed more particularly to a sighting device for use in conjunction with firearms.

2. Description of the Prior Art

Mechanical gun sights for firearms usually include a front and rear sight portion. One customary arrangement, for example, includes a front sight portion comprising a blade member and a rear sight portion comprising a member having a notch therein, it being necessary to properly align the blade in the notch and to align both sight portions with a distant target to provide accurate placement of the firearm discharge. Other embodiments include blade front portions in combination with circular rear sight portions, front cross hairs in conjunction with circular rear sight portions, cross hair front and rear portions, and various such combinations.

A problem with previous mechanical gun sight combinations has been the reluctance of the eye to record a clear image of both the front and rear gun sight portions. It commonly happens that while the eye adjusts to one of the sight portions, the other sight portion appears fuzzy or not clearly defined, or, if the eye adjusts to both sight portions the target appears ill-defined by virtue of the concentration on the two sight portions.

SUMMARY OF THE INVENTION

An object of the present invention is to provide a sighting device for a firearm utilizng a mechanical sight structure disposed at only the muzzle end of the firearm, whereby to eliminate the normal rear sighting element.

A further object of the invention is to provide a firearm sighting device which is non-complex in nature, relatively inexpensive to manufacture, and easy to use.

A still further object of the invention is to provide a sighting device susceptible to fast alignment with a target.

With the above and other objects in view, as will hereinafter appear, a feature of the present invention is the provision of a sighting device for disposition proximate a muzzle end of firearm, the device comprising a first elongated planar member and a second elongated planar member disposed in a plane different from the plane of the first member, each planar member intersecting the plane of the other member at the center of the other member.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
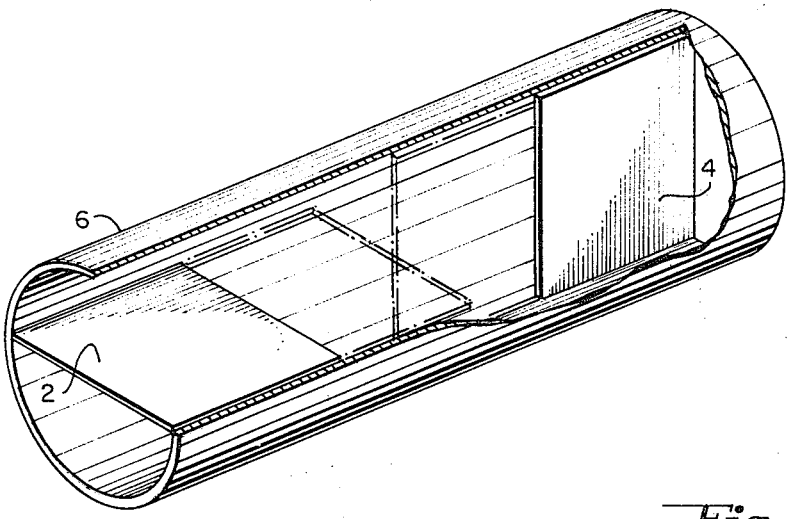
FIG. 1 is a perspective view, partly cut-away, showing one form of sighting device illustrative of an embodiment of the invention, portions in phantom illustrating a second embodiment thereof.

Referring to FIG. 1, it will be seen that the illustrative sighting device includes a first elongated planar member 2 and a second elongated planar member 4. The planar member 4 is disposed in a plane at an angle to the plane of the planar member 2, each of the planar members 2, 4 intersecting the plane of the other member at the center of the other member. In a preferred embodiment, the planar members are disposed normal to each other, but disposition at angles other than 90° are feasible. The device of the present invention may include a tubular member 6, the planar members 2, 4 being disposed in the tubular member 6, the lengthwise edges of the planar members being fixed to an inside wall of the tubular member.

As shown in FIG. 1, the planar members 2, 4 may be separated from each other or, as shown in phantom, may be joined to each other at their center lines in abutting end-to-end relationship.

The lengthwise axes of the planar members 2, 4 are adapted to extend substantially parallel to an axis of a firearm (not shown) to which the device is attached.

The members 2, 4, and the tubular member 6, are of rigid material, preferably of non-reflective blackened metal. The members 2, 4 must be of a length such as to permit the eye of the user to discern the planar surfaces thereof. While different lengths would accommodate different users, the members must be of a length of at least 0.250 inches and of a thickness of less than 0.063 inches. Obviously, the thicker the members 2, 4, the more likely the members are to obscure the target or a portion thereof. Accordingly, a lesser thickness is preferred.

In use, the tubular member 6 is mounted by known means (not shown) to a firearm barrel proximate the muzzle end. If desired, the tubular member 6 may be omitted, and the members 2, 4 connected together as shown in phantom in FIG. 1 and the member 4 connected to the firearm barrel along its lower edge.

Figure 2:
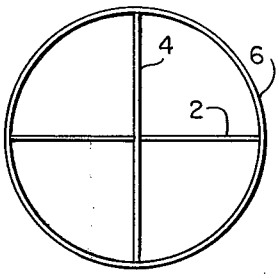
FIG. 2 is an end elevational view of the device shown in FIG. 1.
Figure 3:
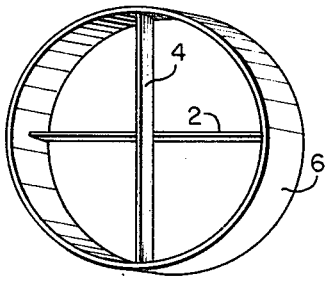
FIG. 3 is an end elevational view similar to FIG. 2, but showing the device out of alignment.

In sighting through the device, the eye of the user has a natural tendency to align the planar members 2, 4 so as to obtain a cross hair image, as seen in FIG. 2. Thus, a misalignment, as seen in FIG. 3, is very quickly corrected and brought to the FIG. 2 position. Inasmuch as both planar members are proximate each other, the eye has no trouble in recording very clearly a simultaneous image of both members.

Figure 4:
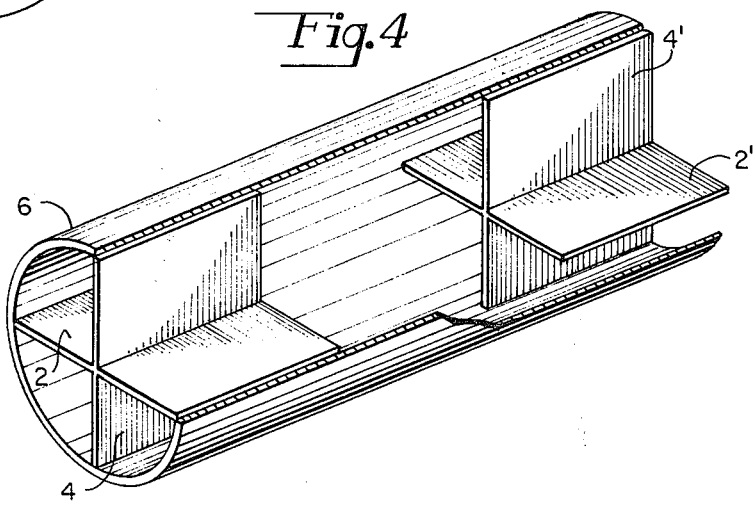
FIG. 4 is a perspective view of an alternative embodiment of the invention.

An alternative embodiment of the present device may be seen in FIG. 4 where the members 2, 4 are joined to each other at their center lines along their lengths to provide an elongated cross configuration. If desired, a second set of planar members $2^1$, $4^1$ may be used in conjunction with the members 2, 4.

The principle of operation of the second embodiment is the same as in the first embodiment. The user, upon sighting through the device, has a natural tendency to bring the firearm to a position in which the planes 2, 4 (and if desired $2^1$, $4^1$) define a cross hair configuration, as seen in FIG. 2. With the planes 2, 4 in alignment with a target the barrel of the firearm to which the sight is attached is also in alignment with the target. In practice, it has been found that a user very quickly brings the sight, and therefore the firearm, into alignment. While the device may be used in the normal position of a rear sight mechanism, it has been found preferable to utilize the sight in the normal position of the front sight.

The above described sight devices present a configuration as shown in FIG. 2 only when the planar members are in perfect alignment. Any movement out of alignment shows the surfaces of the planes, as may be seen in FIG. 3.

The eye quickly detects such change and the operator instantly seeks to correct the imbalance. The eye is sensitive to non-symmetrical images and in the present invention an eye tends to find a stability point when the planar members 2, 4 appear as seen in FIG. 2. Any deviation from that image, as that shown in FIG. 3, is automatically sensed and virtually instantly sought to be corrected.

It is to be understood that the present invention is by no means limited to the particular construction herein disclosed and/or shown in the drawings, but also comprises any modifications or equivalents within the scope of the disclosure. For example, lenses may be incorporated in the device and, in conjunction with the tubular member 6, may operate to keep dust off the planar members 2, 4, as well as provide optical qualities.

Having thus described my invention what I claim as new and desire to secure by Letters Patent of the United States is:

1. Firearm sighting device comprising a first planar member fixed in a first plane, and a second planar member fixed in a second plane, said second plane being at an angle to said first plane, each said planar member intersecting the plane of the other planar member at the center of said other planar member, said planar members each having flat elongated surfaces extending along a line of sight and each having a leading edge surface and a trailing edge surface interconnected by said flat elongated surfaces, and a tubular member, said planar members being in said tubular member, lengthwise edges of said planar members being fixed to an inside wall of said tubular member, said first planar member being proximate a first end of said tubular member and removed from a second end of said tubular member, said second planar member being proximate said second end of said tubular member and removed from said first end of said tubular member, said trailing edge surface of said first planar member being opposed and proximate to said leading edge surface of said second planar member.

2. The invention according to claim 1 in which said trailing edge surface of said first planar member and said leading edge surface of said second planar member are separated from each other but are proximate to each other in edge-to-edge relationship.

3. The invention according to claim 1 in which said trailing edge surface of said first planar member and said leading edge surface of said second planar member are joined edge-to-edge.

4. The invention according to claim 1 in which said flat elongated surfaces of said planar members extend lengthwise along said line of sight in directions substantially parallel to an axis of a firearm barrel portion.

5. The invention according to claim 1 in which said elongated surfaces have a length extending along said line of sight of at least 0.250 inches and said edge surfaces have a thickness of less than 0.063 inches.

* * * * *